US006912736B2

(12) United States Patent
Moeller et al.

(10) Patent No.: US 6,912,736 B2
(45) Date of Patent: Jul. 5, 2005

(54) HELMET FIT ELEMENT

(75) Inventors: Thomas Andrew Moeller, Stateline, NV (US); Andrew Allen Bjornson, Newport Beach, CA (US)

(73) Assignee: Vans, Inc., Santa Fe Springs, CA (US)

( * ) Notice: Subject to any disclaimer, the term of this patent is extended or adjusted under 35 U.S.C. 154(b) by 186 days.

(21) Appl. No.: 10/600,264

(22) Filed: Jun. 20, 2003

(65) Prior Publication Data

US 2004/0255370 A1 Dec. 23, 2004

(51) Int. Cl.[7] ..... A42B 7/00
(52) U.S. Cl. ..... 2/421; 2/416
(58) Field of Search ..... 2/421, 416, 425, 2/417, 415, 418, 419, 420, DIG. 11

(56) References Cited

U.S. PATENT DOCUMENTS

| | | | | | |
|---|---|---|---|---|---|
| 2,814,043 | A | * | 11/1957 | Alesi | 2/421 |
| 3,103,014 | A | * | 9/1963 | Morgan | 2/415 |
| 3,137,859 | A | * | 6/1964 | Zbikowski | 2/418 |
| 3,388,405 | A | * | 6/1968 | Simpson et al. | 2/418 |
| 3,471,866 | A | * | 10/1969 | Raney | 2/418 |
| 3,628,190 | A | | 12/1971 | Molitoris | 2/3 |
| 3,713,640 | A | | 1/1973 | Margan | 267/117 |
| 3,852,821 | A | | 12/1974 | Mickel | 2/3 |
| 4,051,555 | A | * | 10/1977 | Daly | 2/412 |
| 4,263,679 | A | * | 4/1981 | Erlendson | 2/421 |
| 4,434,514 | A | * | 3/1984 | Sundahl et al. | 2/425 |
| 5,123,121 | A | * | 6/1992 | Broersma | 2/421 |
| 5,381,560 | A | | 1/1995 | Halstead | 2/421 |
| 5,638,551 | A | | 6/1997 | Lallemand | 2/421 |
| 5,659,900 | A | | 8/1997 | Arney et al. | 2/417 |
| 5,687,426 | A | * | 11/1997 | Sperber | 2/411 |
| 5,704,072 | A | * | 1/1998 | Garneau | 2/421 |
| 5,774,901 | A | | 7/1998 | Minami | 2/421 |
| 5,794,272 | A | | 8/1998 | Workman et al. | 2/421 |
| 5,887,288 | A | | 3/1999 | Arney et al. | 2/421 |
| 5,953,761 | A | * | 9/1999 | Jurga et al. | 2/425 |
| 5,983,405 | A | | 11/1999 | Casale | 2/421 |
| 6,226,802 | B1 | | 5/2001 | Sasaki et al. | 2/417 |
| 6,425,142 | B2 | | 7/2002 | Sasaki et al. | 2/421 |

OTHER PUBLICATIONS

Japanese Patent, Publication No. 2001–055616, published: Feb. 27, 2001.
Japanese Patent, Publication No. 2001–262424, published: Sep. 26, 2001.

* cited by examiner

*Primary Examiner*—Rodney M. Lindsey
(74) *Attorney, Agent, or Firm*—Winston & Strawn LLP

(57) ABSTRACT

A fit element for a helmet for minimizing helmet movement on the head of a wearer is described. An embodiment of the fit element includes a base portion and an integrated stretchable material. The base portion includes at least one attachment leg, a right side arm and a left side arm, wherein the attachment leg is substantially perpendicular to the right and left arms. The base portion may also include attachment points for connecting to an interior rear area of a helmet, and advantageously has at least one cut-out section along its length to permit flexing. In an implementation, at least a portion of a lower edge of the middle section of the base portion has a curved shape for facilitating entry or the wearer's head into a helmet.

23 Claims, 5 Drawing Sheets

HELMET FIT ELEMENT

BACKGROUND

The invention generally pertains to a fit element for sports helmets. More particularly, the fit element is an integrated base portion and stretchable material component for connection to an interior area of the helmet, to provide an improved fit.

Lightweight sports helmets are commonly used to protect the head of a wearer when engaged in various sports such as skateboarding, snowboarding, skiing, bicycling, mountain biking, sky-diving, water-skiing, wake-boarding and the like. Such helmets typically include various strap arrangements to secure the helmet, and various cushions and pads that may be added to the interior shell of the helmet to customize the fit of the helmet so that it does not move about on an individual's head.

Chin straps are commonly used to keep the helmet attached to the head, but do little to prevent the helmet from rocking back and forth (from the rear of the head towards the face and back again) over the user's head during use. Many helmet models utilize a chin strap that includes a "Y" configuration on each side of the helmet over the ears of the wearer. Such chin strap Y-configurations help to reduce the amount of rocking, or general horizontal helmet movement, but do not eliminate it.

Some prior art strap configurations are unduly complex, utilizing many removable and/or adjustable components making it difficult for a wearer to adjust the fit of the helmet, or difficult to put-on and take-off the helmet. Some require adjustment every time a wearer wishes to put on the helmet. Other systems utilize mechanical means such as gears, racks and levers to provide fit adjustment of the helmet. Such complex systems are typically expensive to manufacture and thus increase the overall cost of the helmet. Moreover, some prior systems fail to provide adequate retention of the helmet on the head of a wearer during strenuous activity, or provide good retention capability but are uncomfortable to wear. Furthermore, many prior art systems required new helmet designs to accommodate the system instead of providing a system that could be retrofit to existing helmet designs.

SUMMARY OF THE INVENTION

Provided is a fit element for connection to an interior area of a helmet shell. The fit element along with other components form a fit system that is intuitive and easy to adjust, and that provides an improved fit. The improved fit minimizes helmet movement, including rocking back and forth, when worn on the head by a user.

In an implementation, the fit element for a helmet includes a base portion and a stretchable material. The base portion includes at least one attachment leg, a right side arm and a left side arm, wherein the attachment leg is substantially perpendicular to the right and left arms. The base portion advantageously includes at least one cut-out section along its length to permit flexing, and attachment points for connecting to an interior rear area of a helmet. The stretchable material is integrated with at least a section of the base portion along its length, for contact with the wearer's head.

In an advantageous implementation, at least a portion of a lower edge of a middle section of the base portion has an outwardly-curved shape for facilitating entry of the wearer's head into a helmet. The base portion may include a plurality of cut-out sections, may also include a plurality of attachment legs, and could include attachment points located at distal ends of the attachment leg, the right side arm and the left side arm, for connection to connection points provided in a helmet liner. A plurality of darts could be used to connect each of the attachment leg, the right side arm and the left side arm to the connection points. The stretchable material may cover substantially all of the base portion, or may cover only selected parts of the base portion, or may cover substantially all of the cut-out sections of the base. The base portion may be composed of at least one of a plastics material, a thermo-plastic elastomer (TPE), a rubber material, a foam rubber material such as ethyl vinyl acetate (EVA), a flexible composite material, leather, or a synthetic material. The base portion and stretchable material can be co-molded together to form an integrated fit element, and the stretchable material could be made of at least one of a four-way stretch fabric, an elastic composite material, or a thin web of the same material used in the base portion. The stretchable material could also be composed of a material capable of wicking away perspiration.

Another variant of the invention pertains to an adjustable fit system for a sports helmet. In an implementation, the adjustable fit system includes a chin strap for connection to an interior of a helmet shell, and a fit element including a base portion and an integrated stretchable material for connection to the interior of the helmet shell. The base portion includes right and left arms for connection to right and left side temple areas of the helmet, and at least one attachment leg that is substantially perpendicular to the right and left arms for connecting to a connection point in a rear area of the helmet. The base portion also includes at least one cut-out section along its length to permit flexing.

The fit system for a helmet may also include interior pads for placement by a wearer into the helmet to provide a comfortable and secure fit, and may include a webbing.

Another implementation according to the invention pertains to a sports helmet that includes a helmet shell for substantially covering a top portion of a wearer's head, an adjustable chin strap attached to the either side of the helmet shell for extending under the chin of a wearer to removably fasten the helmet shell to the top portion of the wearer's head, and a fit element for connection to a rear interior portion of the helmet shell. The fit element includes a base portion having right and left arms for connection to right and left side temple areas of the helmet shell, and at least one attachment leg that is substantially perpendicular to the right and left arms for connection to a rear area of the helmet shell, and a stretchable material integrated with at least a section of the base portion. The base portion includes at least one cut-out section along its length to permit flexing.

A fit element according to the invention enables a helmet manufacturer to provide a helmet that will securely and comfortably fit the head sizes and shapes of a plurality of users. Consequently, fewer helmet shell sizes of a particular style helmet need to be manufactured to ensure availability of those helmets to fit the majority of consumers, resulting in an overall cost savings that can be passed on to the consumer. Furthermore, a fit element according to the invention along with the other described components form a fit system that is intuitive and easy to adjust for a comfortable fit, which encourages athletes to wear the helmet. In addition, the embodiment of the fit element that includes the slight outward curve of the lower portion of the base portion helps to guide and ease the head into the shell because it follows the natural curve of the rear portion of the head. Yet further, the stretchable material comfortably contacts the head of the wearer to accommodate the head when putting the helmet on, taking it off, or when the helmet is in use, and may have the ability to wick away any perspiration to cool the head of the wearer as she exercises or is involved in other strenuous activities. Moreover, the base portion is designed to provide stability and thus to ensure a secure fit to minimize or eliminate rocking of the helmet. This results in improving the safety factor of the helmet, because a securely fitted helmet protects the head in case of a fall or other accident.

BRIEF DESCRIPTION OF THE DRAWINGS

Like reference numbers in the various drawings indicate like components.

DETAILED DESCRIPTION OF THE PREFERRED EMBODIMENTS

Figure 1:
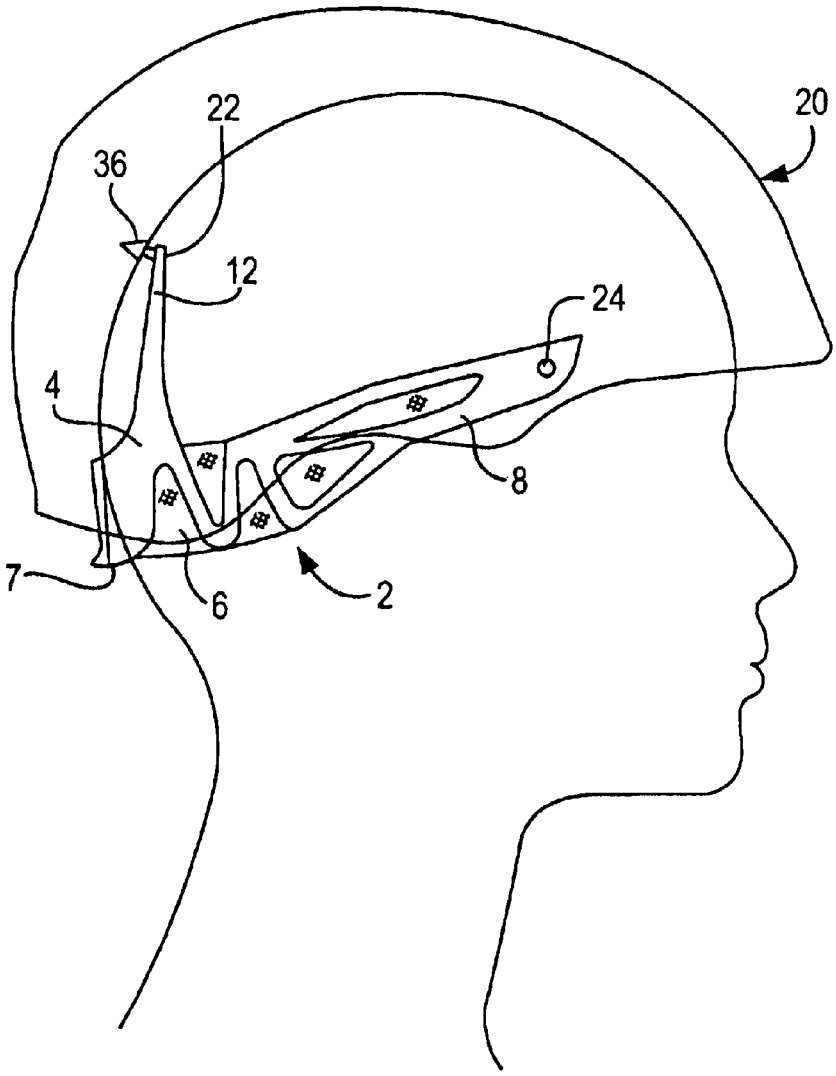
FIG. 1 is a simplified, partial cutaway side view of a helmet including a first implementation of a fit element according to the invention.

FIG. 1 is a simplified, partial cutaway side view of an implementation of a fit element 2 connected to an interior portion of a rear area of a helmet 20. The helmet is shown in outline and covering the head of a wearer, and other details, such as a webbing and a chin strap, have been omitted for ease of understanding. The fit element 2 includes a base portion 4 integrated with a stretchable or flexible material 6. The fit element 2 may be part of a fit system that can include an adjustable chin strap, webbing and foam pads. The foam pads may be inserted by a wearer in front or top areas of the helmet shell to customize the fit to his head.

The base portion of the fit element includes a right side arm 8, a middle section 9 (see FIG. 2), a left side arm 10, a right side vertical attachment leg 12, and a left side vertical attachment leg 14. The vertical attachment legs are substantially perpendicular to the side arms and middle section. The fit element 2 is attached to the helmet in at least one rear interior connection point 22 adjacent a top portion of the head, and at a right side connection point 24 and at a left side connection point 26 (shown in FIG. 2) adjacent the temple areas of the head. When worn on the head, the rear portion 9 of the fit element 2 is at least minimally biased against the back of the neck, at or below the occipital region of the head. Consequently, the fit element, chin strap, and any foam pads that may have been inserted in the front interior area of the helmet shell, act together to minimize or prevent rocking of the helmet on the head of the wearer.

Figure 2:
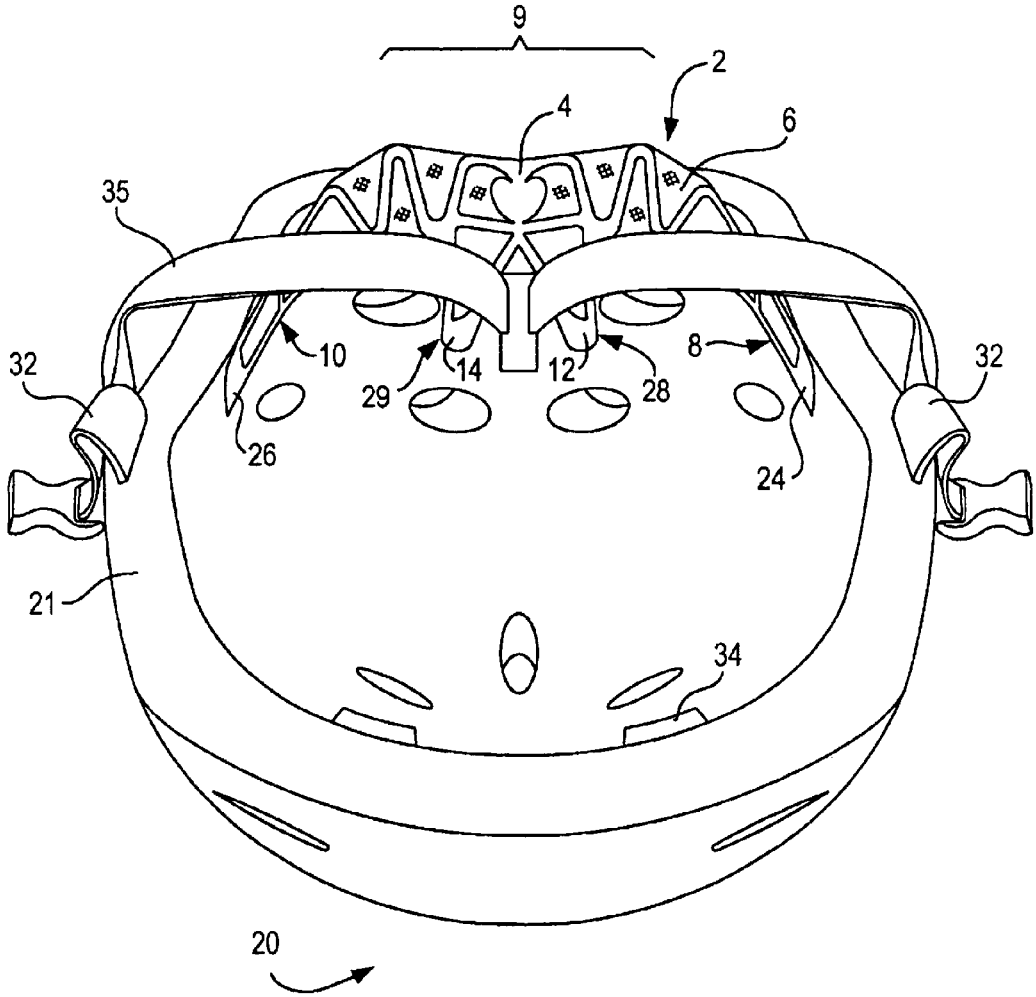
FIG. 2 is a bottom view of a helmet similar to that of FIG. 1, including a second embodiment of a fit element according to the invention.

FIG. 2 is a bottom view of a helmet 20 and fit element 2 that is similar to that shown in FIG. 1. The helmet includes a chin strap 32, interior pads 34, and a webbing 35. In this implementation, the fit element 2, chin strap 32, interior pads 34 and webbing 35 together form a helmet fit system that minimizes movement of the helmet on the head of a wearer. Other helmet fit system configurations may not include one or more of the foregoing components, for example, a wearer may not need to attach any interior pads to the inner portion of the foam liner 21 to obtain a good fit of the helmet.

Referring again to FIG. 2, The right and left side vertical attachment legs 12, 14 can be attached to the foam liner 21 of the helmet 20 by darts 36 (see FIG. 1) at right and left rear connection points 28, 29. The darts engage with holes in baskets (not shown) that are molded into the foam liner 21 of the helmet shell. A plurality of holes may be provided in each basket so that the legs 12, 14 can be adjusted to accommodate the head size and shape of a wearer to achieve a comfortable and secure fit. Similarly, the right and left side arms 8, 10 may also be attached to the foam liner 21 by darts 36 at right side and left side connection points 24, 26 to allow a user to adjust the circumference of the fit system which includes the fit element 2. Other types of attachment means, such as pins, snaps, pop rivets, screws that attach to in-molded anchors, hook-and-loop fasteners, and the like, could also be used.

When the wearer initially uses the helmet with the fit element 2, she attaches the leg and arms and may readjust their connection points after trying the helmet on one or more times, so as to obtain a secure and comfortable fit. After this initial set-up operation, which may involve multiple connection attempts to find a comfortable and secure fit, the helmet fit element and fit system automatically function to securely and comfortably cradle the wearer's head. The fit element is designed to flex or have a certain amount of "give" about the rear portion of the circumference of the head of the wearer.

Figure 3A:
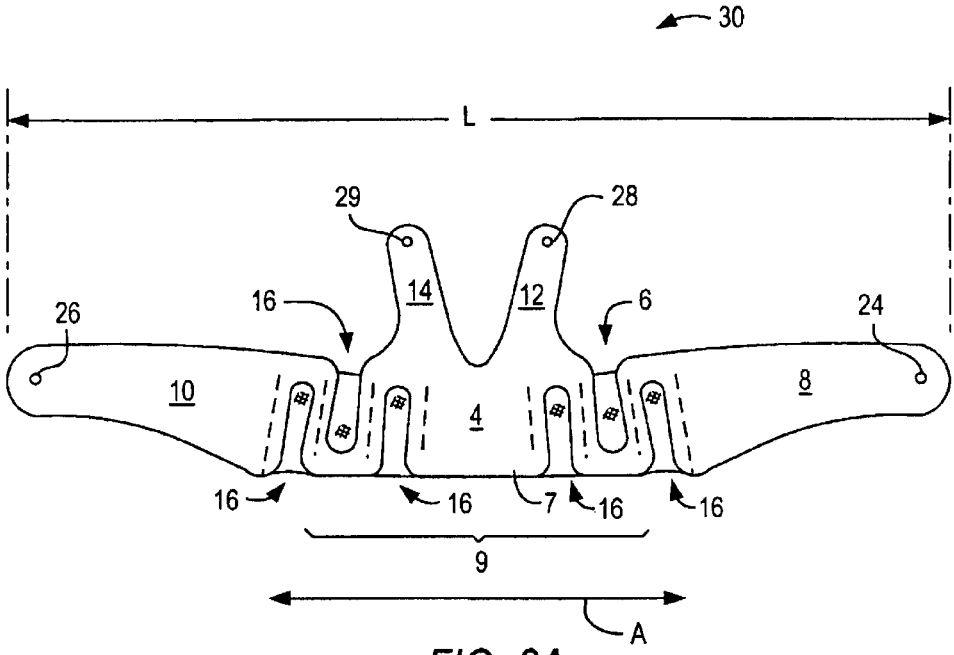
FIG. 3A shows another embodiment of a fit element before insertion into a helmet.

FIG. 3A shows a fit element 30 before insertion into a helmet. In this implementation, the fit element 30 is a unitary member composed of multiple materials that have been co-molded together. It is also possible to mold the fit element components of the same material, for example a plastics material could be used wherein a very thin web of that plastic material is utilized as the web in place of the stretchable fabric. Such a component may be cost effective to manufacture, and still provide a comfortable fit.

In the implementation shown in FIG. 3A, an elastic stretch fabric 6 is positioned only in the rearmost area along the perimeter, to cover a section or part along a portion of the length of the base 4. The stretchable material 6 may be a flexible four-way stretch fabric that could be co-molded about a portion of the perimeter of the base portion, and could be about one to two inches wide. It should be understood, however, that the stretchable material may be associated only with select areas of the base portion, or can be associated with the entire perimeter, or could cover the entire base portion. The stretchable fabric may be any number of known materials, is capable of stretching about the head of the wearer in a plurality of directions to provide a comfortable fit, and may be capable of wicking away sweat. As shown in FIG. 3A, the flexible material is stitched to the base portion at several locations and does not cover the entire area between the connection point 26 of the left arm 10 and the connection point 24 of the right arm 8. It should also be understood, however, that the flexible material 6 may be attached to the base portion 4 in any number of ways, such as by co-molding, gluing, use of other adhesives or by other attachment means.

The base portion 4 of the fit element may be made of a thin material on the order of about 2 millimeters (mm) thick (or about 0.080 inches thick). The base portion provides structure, and defines the shape or form of the fit element. Preferably, the base is composed of a rigid or a semi-rigid material capable of chemically bonding with the flexible material during a co-molding process. Examples of suitable base portion materials include, but are not limited to, plastics materials, thermo-plastic elastomer (TPE) materials, rubber or rubber-like materials, foam rubber materials such as ethyl vinyl acetate (EVA), flexible composite materials, leather, synthetic materials, or other semi-rigid or rigid materials that can be molded or otherwise formed to produce the base portion. When the base portion and flexible material are co-molded together, a fit element having a smooth surface results, which can comfortably contact the head of a wearer.

The base portion includes a plurality of cut-out sections 16 that permit a restricted amount of flexing in a substantially horizontal direction, as indicated by the double-headed arrow "A" in FIG. 3A. For example, the length "L" of the fit element in a relaxed state may be approximately 375 mm (about 14.8 inches) long, and may be capable of stretching to a length of about 415 mm (or about 16.25 inches) when a consumer having a relatively large head is putting on the helmet. The number of cut-out sections can be chosen to provide more or less flexing or stretching ability. The stretch fabric also flexes in the horizontal direction indicated by the arrow "A" in concert with the base portion. In an advantageous implementation, the lower edge 7 of the middle section 9 of the base element 4 has a slightly curved shape (see FIG. 1) in an outward direction, which serves to ease the helmet onto a wearer's head (in the same manner that a shoe horn aids in fitting tight shoes onto the feet).

The materials used to form, and the structure of, the fit element ensures that a wide range of head sizes and/or head shapes are able to fit inside a given size helmet shell. In particular, as the helmet is placed on the head, the base portion 4 and flexible material 6 stretch along the length "L" (in the directions indicated by double-headed arrow "A") to accommodate the head, then partially return in the direction of the initial state of the fit element. When the helmet is seated correctly on the head, the rear portion 7 cradles the head above the neck and below the occipital region of the wearer. The fit element 2 exerts a slight pressure on the head of the wearer, which in concert with the chin strap, webbing and foam pads, ensures a comfortable and secure fit of the helmet to the head. The location of the attachment points in the liner of the helmet is also important to permit the fit element 2 to function in this manner. The fit system thus stabilizes the helmet on the head to minimize or eliminate rocking of the helmet during use.

Figure 3B:
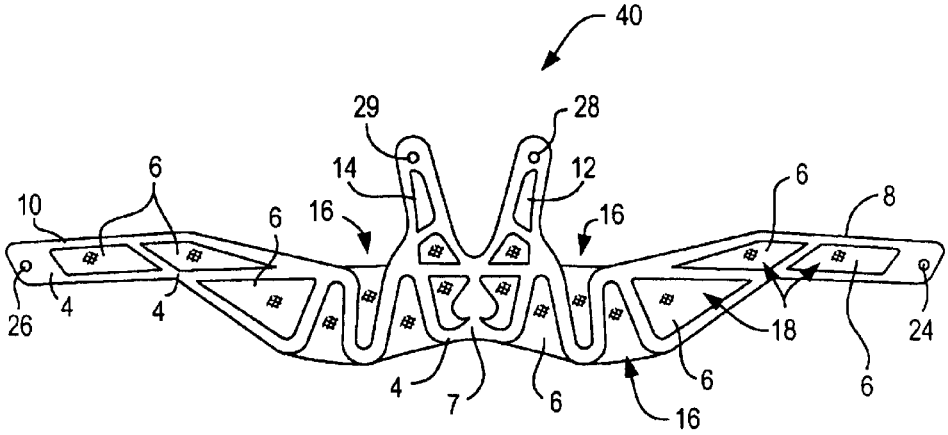
FIG. 3B illustrates a yet another embodiment of a fit element according to the invention that includes a lattice structure.

FIG. 3B illustrates another embodiment of a fit element 40. The fit element 40 has a plastic base portion 4 having a lattice-like structure that includes a plurality of apertures 18 and cut-out sections 16. An elastic material 6 may be co-molded to bond to the entire lattice structure so that all of the apertures 18 and cut-out portions 16 are covered with material 6 as shown. In this implementation, when the fit element 40 is installed in a helmet, the head of the wearer contacts only the elastic or stretchable material 6.

Figure 3C:
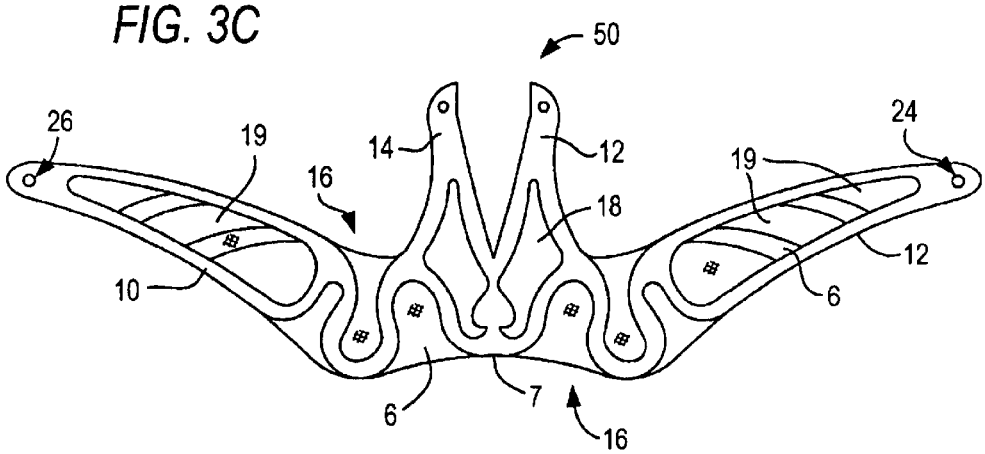
FIGS. 3C to 3E illustrate further embodiments of a fit element according to the invention.
Figure 3D:
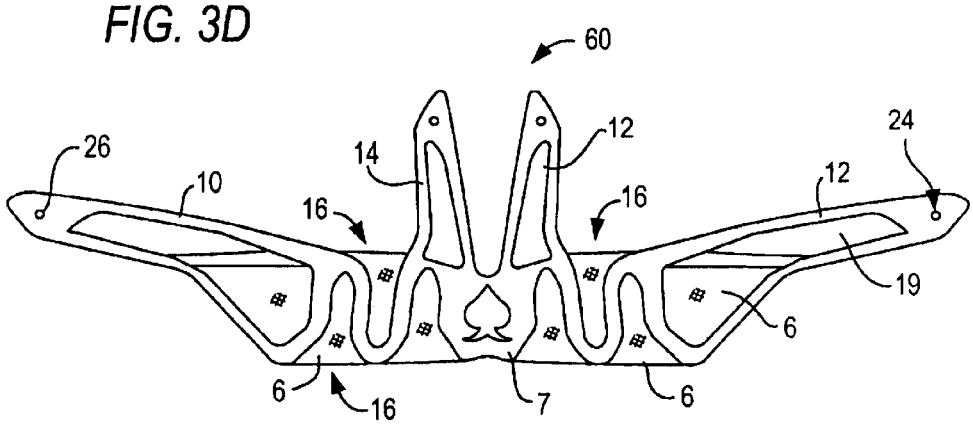
Figure 3E:
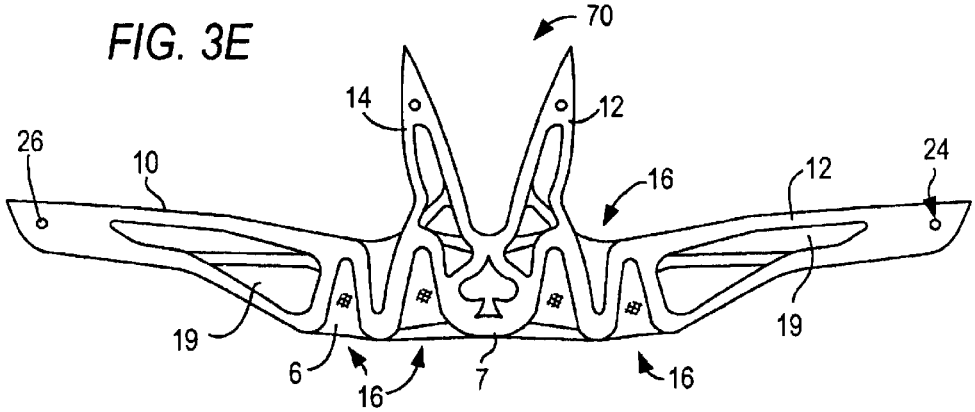

FIGS. 3C, 3D and 3E illustrate alternate embodiments 50, 60 and 70 of a fit element. Each of these fit elements also includes a lattice-type base portion, and the elastic material 6 is connected to each in a manner that covers only certain sections or parts of the base portion. For example, in FIG. 3C, openings 19 are not entirely covered by material 6, whereas the material 6 spans the cut-out sections 16. FIGS. 3D and 3E similarly include elastic material 6 that covers less than the entire base portion. It should be understood that various configuration types could be implemented that are designed to satisfy various requirements such as being light weight, exhibiting a minimum or maximum amount of flex, being sturdy, and to present a pleasing or fashionable appearance.

Figure 4A:
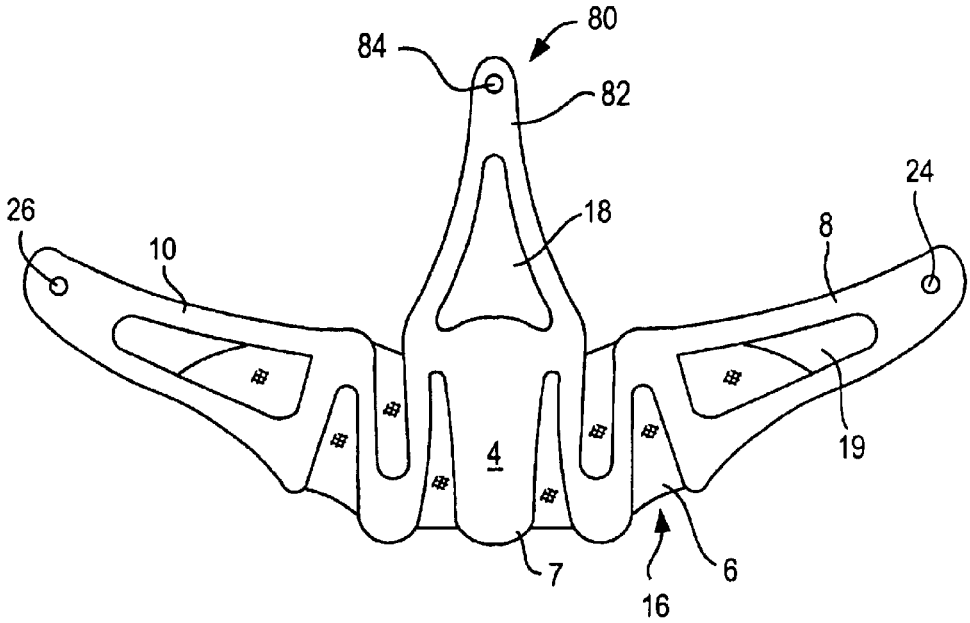
FIG. 4A is yet another embodiment of a fit element according to the invention that has a single attachment leg.
Figure 4B:
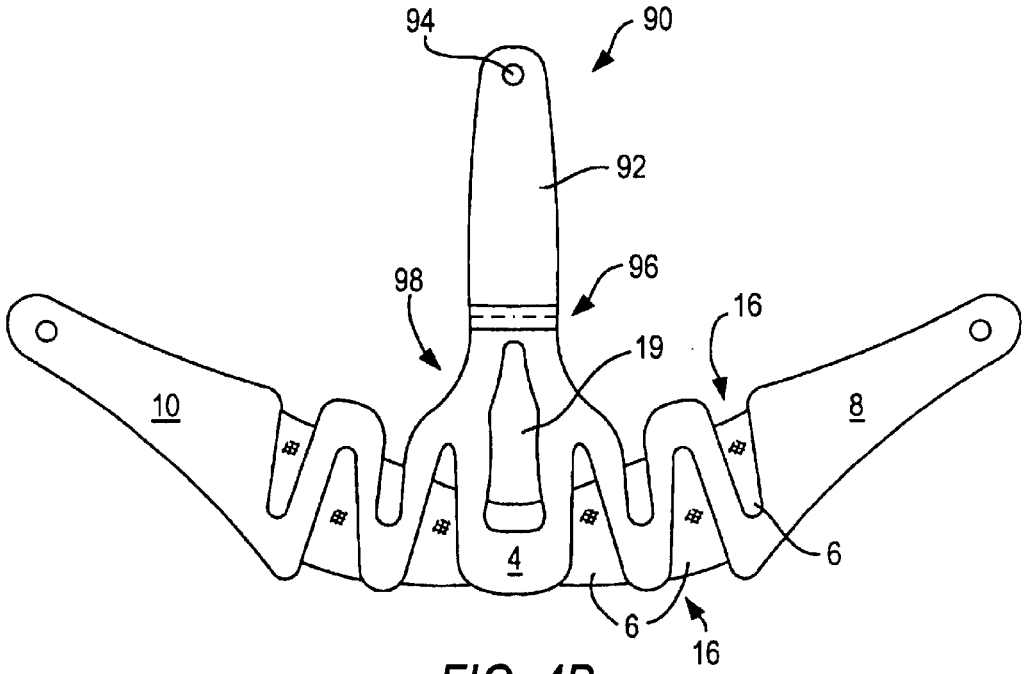
FIG. 4B is another a fit element according to the invention that includes a single attachment leg and a flexible joint.

FIG. 4A illustrates another embodiment of a fit element 80 that includes left and right arms 8, 10, and a single vertical attachment leg 82 having an attachment hole or slot 84. The attachment leg 82 would be used to anchor the fit element 80 to one interior connection point at the rear of the helmet. Similarly, FIG. 4B illustrates yet another embodiment of a fit element 90 that includes left and right arms 8, 10, and a single vertical attachment leg 92 having an attachment hole or slot 94. The vertical attachment leg 92 also includes a flexible joint 96, which may be a thin section of material that has been scored so that the bottom portion 98 of the fit element 90 can pivot about the joint 96 in a back-and forth (front-to-rear direction) manner when connected to the helmet. Such a joint design may impart increased flexibility to the fit element 90 to ensure a comfortable and secure fit. The flexible joint may also comprise other well-known structures, such as a ball and socket arrangement, but a simple and lightweight pivot joint or pivot point structure such as that shown in FIG. 4B is preferred. It should also be understood that such flexible joints could be incorporated with any of the fit element embodiments described previously herein.

Although particular implementations have been described, it should be understood that one of skill in the art could make many changes or modifications that would fall within the scope of the invention. For example, the number of spaces and/or apertures in the base portion could be increased or decreased, other methods of joining a base portion and a flexible material could be used, implementations may include a plurality of flexible joints, and more or less connector and/or attachment points could be provided.

What is claimed is:

1. A fit element for a helmet for minimizing helmet movement on the head of a wearer comprising:

a base portion comprising at least one attachment leg, a right side arm and a left side arm, wherein the attachment leg is substantially perpendicular to the right and left arms, the base portion including attachment points for connecting to an interior rear area of a helmet; and a stretchable material integrated with at least a section of the base portion along its length, for contact with the wearer's head;

wherein the base portion includes at least one cut-out section along its length to permit flexing.

2. The apparatus of claim 1 wherein at least a portion of a lower edge of a middle section of the base portion has a curved shape for facilitating entry of the wearer's head into a helmet.

3. The apparatus of claim 1 wherein the base portion includes a plurality of cut-out sections.

4. The apparatus of claim 1 which further comprises attachment points at distal ends of the attachment leg, the right side arm and the left side arm, for connection to connection points provided in a helmet liner.

5. The apparatus of claim 4 further comprising a plurality of darts for connecting each of the attachment leg, the right side arm and the left side arm to the connection points.

6. The apparatus of claim 1 wherein the stretchable material covers substantially all of the base portion.

7. The apparatus of claim 1 wherein the stretchable material covers only selected parts of the base portion.

8. The apparatus of claim 7 wherein the stretchable material covers substantially all of the cut-out sections of the base portion.

9. The apparatus of claim 1 wherein the base portion is composed of at least one of a plastics material, a thermoplastic elastomer (TPE), a rubber material, a foam rubber material, a synthetic material, leather, or a flexible composite material.

10. The apparatus of claim 1 wherein the base portion includes a plurality of attachment legs for connection to a rear interior area of the helmet.

11. The apparatus of claim 1 wherein the stretchable material is composed of a material capable of wicking away perspiration.

12. The apparatus of claim 1 wherein the base portion and stretchable material are co-molded together to form an integrated fit element.

13. The apparatus of claim 1 wherein the stretchable material is made of at least one of a four-way stretch fabric, an elastic composite material, or a thin web of the same material used in the base portion.

14. An adjustable fit system for a sports helmet comprising:

a chin strap for connection to an interior of a helmet shell; and a fit element for connection to the interior of the helmet shell, the fit element comprising a base portion including right and left arms for connection to right and left side temple areas of the helmet, and at least one attachment leg that is substantially perpendicular to the right and left arms for connecting to a connection point in a rear area of the helmet, and a stretchable material integrated with at least a section of the base portion;

wherein the base portion includes at least one cut-out section along its length to permit flexing.

15. The apparatus of claim 14 wherein at least a portion of a lower edge of a middle section of the base portion has a curved shape for facilitating entry of the wearer's head into the helmet.

16. The apparatus of claim 14 further comprising interior pads for placement by a wearer into the helmet to provide a comfortable and secure fit.

17. The apparatus of claim 14 further comprising a webbing.

18. The apparatus of claim 14 wherein the fit element includes a plurality of attachment legs for connection to a rear interior section of the helmet.

19. A sports helmet comprising:

a helmet shell for substantially covering a top portion of a wearer's head;

an adjustable chin strap attached to the either side of the helmet shell for extending under the chin of a wearer to removably fasten the helmet shell to the top portion of the wearer's head; and a fit element for connection to a rear interior portion of the helmet shell, the fit element comprising a base portion including right and left arms for connection to right and left side temple areas of the helmet shell, and at least one attachment leg that is substantially perpendicular to the right and left arms for connection to a rear area of the helmet shell, and a stretchable material integrated with at least a section of the base portion;

wherein the base portion includes at least one cut-out section along its length to permit flexing.

20. The apparatus of claim 19 wherein at least a portion of a lower edge of a middle section of the base portion has a curved shape for facilitating entry of the wearer's head into the helmet shell.

21. The apparatus of claim 19 further comprising interior pads for placement by a wearer into the helmet to provide a comfortable and secure fit.

22. The apparatus of claim 19 further comprising a webbing.

23. The apparatus of claim 19 wherein the fit element includes a plurality of attachment legs for connection to a rear interior section of the helmet shell.

* * * * *